US005911565A

United States Patent [19]

Mann et al.

[11] Patent Number: 5,911,565

[45] Date of Patent: Jun. 15, 1999

[54] PUMP FOR CONVEYING HOT MEDIA

[75] Inventors: Ralf Mann, Huje; Hauke Kuhrt, Wewelsfleth, both of Germany

[73] Assignee: Sterling Fluid Systems (Germany) GmbH, Itzehoe, Germany

[21] Appl. No.: 08/913,129

[22] PCT Filed: Mar. 5, 1996

[86] PCT No.: PCT/EP96/00921

§ 371 Date: Nov. 14, 1997

§ 102(e) Date: Nov. 14, 1997

[87] PCT Pub. No.: WO96/27740

PCT Pub. Date: Sep. 12, 1996

[30] Foreign Application Priority Data

Mar. 6, 1995 [DE] Germany ..... 295 03 806 U

[51] Int. Cl.[6] ..... F04B 39/06

[52] U.S. Cl. ..... 417/373; 417/423.8

[58] Field of Search ..... 417/201, 423.12, 417/373, 423.8

[56] References Cited

U.S. PATENT DOCUMENTS

| | | | |
|---|---|---|---|
| 2,202,424 | 5/1940 | Hough | 417/373 |
| 2,484,275 | 10/1949 | Eastman | 417/373 |
| 3,738,781 | 6/1973 | Hagemann et al. . | |
| 4,172,697 | 10/1979 | Schoen | 417/372 |
| 4,632,643 | 12/1986 | Nielsen . | |
| 5,624,245 | 4/1997 | DeClerck et al. | 417/373 |

FOREIGN PATENT DOCUMENTS

| | | | |
|---|---|---|---|
| 0 535 365 A1 | 4/1993 | European Pat. Off. . | |
| 2074162 | 10/1971 | France . | |
| 26 30 513 A1 | 1/1978 | Germany . | |
| 27 50 967 B1 | 4/1979 | Germany | 417/372 |
| 130962 | 3/1929 | Switzerland . | |
| 912711 | 12/1962 | United Kingdom . | |
| 998313 | 7/1965 | United Kingdom . | |

*Primary Examiner*—Charles G. Freay
*Assistant Examiner*—Cheryl J. Tyler
*Attorney, Agent, or Firm*—Alix, Yale & Ristas, LLP

[57] ABSTRACT

The invention concerns a pump for conveying hot media wherein the pump has a pump housing, a seal housing (13, 14) disposed at a distance from the pump housing and is connected thereto, a bearing housing (19) connected to the pump housing via a Chinese lantern-shaped structure (7, 17, 18) and is disposed at a spacing from the seal housing, a fan wheel (22) disposed in the spacing, and a shaft (4) which penetrates the aforementioned parts. The delivery direction of the fan wheel extends from the connection between the pump housing and the seal housing (13, 14) towards the bearing housing (19) to enhance the cooling of the seal housing (13, 14) and of the bearing housing (19). To further enhance the thermal cooling properties, the drive motor is screed from the heated air flow by the bearing housing (19) and by a heat-insulating device (10) on the pump housing. A protective plate (23) surrounding the fan wheel (22) and the seal housing (13, 14) is used to guide the air such that the air drawn in first flows radially to the seal housing (13, 14) and is then deflected axially.

5 Claims, 1 Drawing Sheet

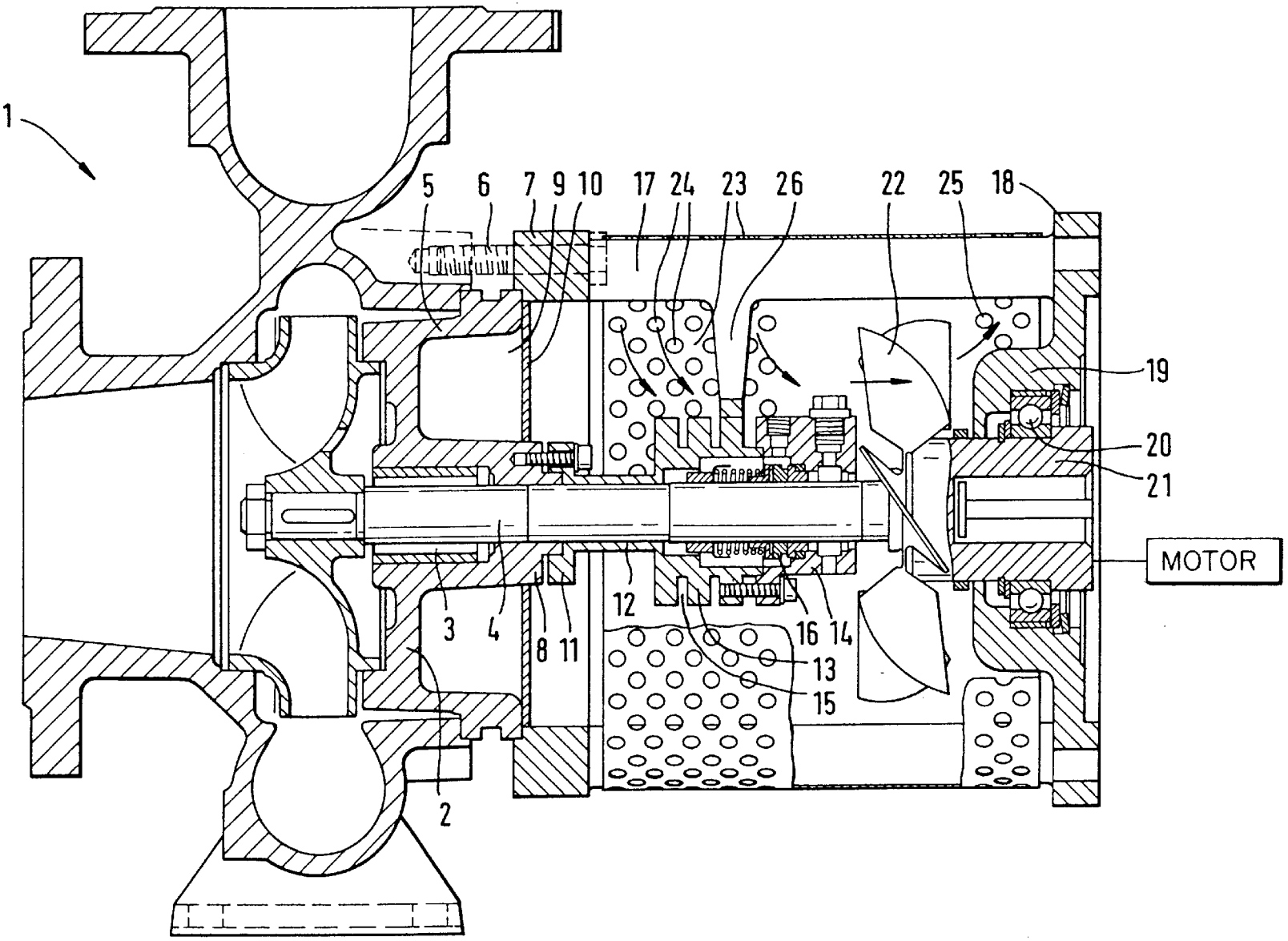
MOTOR
1
2
3
4
5
6
7
8
9
10
11
12
13
14
15
16
17
18
19
20
21
22
23
24
25
26

PUMP FOR CONVEYING HOT MEDIA

CROSS-REFERENCE TO RELATED APPLICATIONS

This is the national stage of International Application No. PCT/EP96/00921 filed Mar. 5, 1996.

BACKGROUND OF THE INVENTION

The service life of the seal and of the rolling bearing of a pump shaft depends on the temperature. With an increasing temperature of the medium to be delivered by the pump—for example hot oil at 350° C.—increasing requirements are placed on the temperature resistance or cooling of the seal and bearing housing. It is known (EP-A 535365) to arrange the seal housing of a centrifugal pump for delivering hot media at an axial distance from the pump housing, to arrange the drive-side shaft bearing at a distance from the bearing housing and to provide a fan on the shaft in the spacing between the shaft bearing and the seal housing, which fan sucks in ambient air and drives it in the direction towards the pump axially over the surface of the seal housing in order to cool the latter. This flow direction is plausible because the flow leaving the fan wheel has a higher speed than the intake flow, and because the air flow heated by the seal housing and the pump surface is conducted away from the drive motor which is sensitive to temperature and is arranged on the other side of the bearing housing. Since it is undesirable also to cool the pump by means of the air flow, in the known pump a thermal insulation device is provided on the side of the pump facing the air flow.

In another known pump (GB-B-998313), air is fed to a heat exchanger by the fan located between the seal and the drive motor, which heat exchanger provides the seal with cooled liquid. The air sucked in by the fan brushes along the end face of the seal housing facing the motor and cools the said seal housing. Since the cooling effect is based primarily on the cooling liquid fed directly to the seal, no devices are provided which ensure intensive air cooling of the seal housing.

SUMMARY OF THE INVENTION

A motor pump arrangement is known (DE-A 27 50 967), in which a fan wheel is arranged between the motor and the pump, which fan wheel serves to drive ambient air as a cooling medium through a heat exchanger which is likewise arranged between the motor and the pump. Since the pump is not hot and there are no housing parts to be cooled between the motor and the pump, the type of air conduction to the fan wheel has no thermal significance. In particular, the fact that the air can impinge radially on the coupling provided between the pump and the motor has no functional relevance to the invention at all. The present invention overcomes the disadvantages of the above-described prior art pumps with respect to the cooling of the seal housing.

Accordingly, the invention is characterized in that the delivery direction of the fan wheel runs from the pump to the bearing housing, and in that the air inlet cross-sections formed by the guard plate are arranged in the axial region of the seal housing and/or on the pump side thereof in such a way that the air impinges with a radial direction component on the seal housing and/or the connection between the seal housing and the pump housing and is deflected on the seal housing towards the fan wheel.

It is surprising that an intensification of the cooling effect is thus achieved. On the one hand, this is attributed to the fact that the effect of the fan wheel is improved because its intake conditions are improved owing to the air flowing into it axially. On the other hand, the improvement is based on the fact that the deflection of the air flow taking place directly on the surface of the seal housing or just ahead of it improves the thermal transfer on the surface of the seal housing. In this case, the thermal insulation device located between the pump housing and the seal housing ensures that the air flow sucked in is not heated unnecessarily before it reaches the seal housing.

The thermal insulation device can simply be formed by a metal washer which is fitted in front of the pump housing and encloses with the latter a thermally insulating air space.

As is known per se, it may be expedient for the seal housing to be connected to the pump housing via a pipe of small cross-section (DE-A 26 30 513) in order to reduce the heat flow to the seal housing. Furthermore, it may be expedient for the same reason to provide the seal housing with circumferential grooves which, at the same time, increase the surface of the seal housing giving off heat.

In order that the drive motor is not affected by the heated air, it is expedient to design the bearing housing in such a way that it screens the motor from the fan.

BRIEF DESCRIPTION OF THE DRAWING

The invention is explained in greater detail below with reference to the drawing which depicts a preferred embodiment in a diagrammatic longitudinal section.

DETAILED DESCRIPTION OF THE INVENTION

The housing of the pump 1 comprises a lid 2 which forms a bearing 3 for the shaft 4 and is tightly connected to the rest of the pump housing in the region of an axially projecting collar 5. The connection is brought about by screw bolts 6 which engage on a ring 7 which is fitted to match the collar 5.

The housing hub 8 containing the bearing 3 is likewise axially extended in relation to the housing wall connecting it to the collar 5, specifically even further than the collar 5. The space 9 located between them is sealed by a metal washer 10 which, in conjunction with the air space 9, acts as a thermal insulation device because it prevents heat being given off in an uninhibited manner from the lid 5 to the ambient air.

Attached to the housing hub 8 is a flange 11 which bears the seal housing via a pipe 12 of small cross-section, the seal housing being composed of a part 13 on the pump side and a part 14 remote from the pump. The part 13 of the seal housing near to the pump contains circumferential grooves 15 which constrict the cross-section of the housing available for conducting the heat from the pump to the seal 16. The ring 7 connected to the pump housing bears a number (for example two to four) of longitudinal struts 17 which connect it to the flange 18 of the bearing housing 19. The parts 7, 17 and 18 form a lantern which connects the bearing housing 19, integrally connected thereto, to the pump housing. From the longitudinal struts 17 of the lantern, a plurality of supporting projections 26 extend radially inwards to the seal housing 13, 14 for the purpose of centering the latter.

Contained in the bearing housing 19 is a rolling bearing 20 for the shaft 4 which is designed here as a coupling bush 21 to receive the shaft stub of a drive motor which can be attached to the flange 18.

Between the seal housing 13, 14 and the bearing housing 19 there is an axial spacing in which a fan wheel 22 is arranged fixed against rotation on the shaft. Its purpose is to cool the bearing housing 19 and the seal housing 13, 14 by means of cooling air sucked in from the environment.

In order that no-one can reach inadvertently between the longitudinal struts 17 into the revolving fan wheel 22, a guard plate 23 is provided which surrounds the region enclosed by the lantern 7, 17, 18 and extends from the ring 7 up to the flange 18. It contains air inlet and outlet cross-sections in the form of holes 24, 25. The air inlet and outlet cross-sections could also be of a different design.

According to the invention, the delivery direction of the fan wheel 22 is chosen so that the delivery runs in the direction of the arrows from the pump towards the drive side. The air inlet openings 24 are located with an axial distance from the fan 22. Since the air enters through them with a primarily radial flow direction, it is guided onto the seal housing 13, 14 and onto the pipe piece 12 before it is deflected axially and is fed by the fan 22 via the surface of the bearing housing 19 to the air outlet openings 25. The guard plate 23 is designed to be uninterrupted in the region of the fan wheel 22 up to a certain axial distance on the pump side thereof in order to guarantee an axial inflow of the cooling air to the fan wheel 22. Furthermore, the axial inflow is ensured by the struts 17 of the lantern which run axially parallel and virtually act as guide devices.

It was found that in this way better cooling of the seal housing 13, 14 and of the bearing housing 19 is achieved than with the conventionally reversed flow direction.

We claim:

1. Pump for delivering hot media comprising:

a pump housing;

a pump impeller disposed in said pump housing;

a seal housing (13,14) which is arranged remote from the pump housing and connected thereto;

a bearing housing (19) spaced from the seal housing (13,14);

a fan wheel (22) arranged in a spacing between said bearing housing and said seal housing;

a shaft (4) connecting said pump impeller, seal housing, and fan wheel;

a guard plate (23) surrounding the fan wheel (22) and forming air inlet and outlet cross-sections (24, 25) which are arranged on both sides of the fan wheel (22) in such a way that the seal housing lies in the air flow of the fan wheel (22);

a thermal insulation device (1) between the pump housing (2) and said spacing, characterized in that the delivery direction of the fan wheel (22) runs from a connection between the seal housing and the pump housing towards said bearing housing (19); and the air inlet cross sections (24) are arranged in the axial region between said fan wheel and said thermal insulation device in such a way that air impinges with at least one of a radial direction component on the seal housing and said connection between the seal housing and the pump housing and said impingement air is deflected on the seal housing towards the fan wheel.

2. Pump according to claim 1, characterized in that the thermal insulation device comprises a metal washer (10) which is fitted in front of the pump housing (2) and encloses an air space (9) with the larger part of the surface of the pump housing (2) covered by said washer.

3. Pump according to claim 1, characterized in that the seal housing (13, 14) is connected to the pump housing (2) via a pipe (12) of small cross-section.

4. Pump according to claim 1, characterized in that the seal housing (13, 14) has circumferential grooves (15) at least in the pump-side region (13).

5. Pump according to claim 1, characterized in that a drive motor to be arranged on the other side of the bearing housing (19) is screened from the fan (22) by the bearing housing (19).

* * * * *